US012318681B2

(12) United States Patent
Gabriels

(10) Patent No.: US 12,318,681 B2
(45) Date of Patent: Jun. 3, 2025

(54) END PIECE FOR CUE

(71) Applicant: GDM SPORTS BV, Ranst (BE)

(72) Inventor: Thierry Maria Rene Carl Gabriels, Vremde (BE)

(73) Assignee: GDM SPORTS BV, Ranst (BE)

( * ) Notice: Subject to any disclaimer, the term of this patent is extended or adjusted under 35 U.S.C. 154(b) by 964 days.

(21) Appl. No.: 17/413,671

(22) PCT Filed: Dec. 13, 2019

(86) PCT No.: PCT/IB2019/060748

§ 371 (c)(1),
(2) Date: Jun. 14, 2021

(87) PCT Pub. No.: WO2020/128745

PCT Pub. Date: Jun. 25, 2020

(65) Prior Publication Data

US 2022/0008813 A1 Jan. 13, 2022

(30) Foreign Application Priority Data

Dec. 17, 2018 (BE) ..... 2018/5890

(51) Int. Cl.
*A63D 15/12* (2006.01)

(52) U.S. Cl.
CPC ..... *A63D 15/12* (2013.01)

(58) Field of Classification Search
CPC ..... A63D 15/12; A63D 15/08
See application file for complete search history.

(56) References Cited

U.S. PATENT DOCUMENTS 1,040,362 A * 10/1912 La Fevre ..... A63D 15/12 473/49
1,182,160 A * 5/1916 Fournier ..... A63D 15/12 473/49
1,648,613 A * 11/1927 Grenier ..... A63D 15/12 473/49
3,598,409 A * 8/1971 Nemecek ..... A63D 15/12 264/274
5,356,345 A 10/1994 Peuplie
(Continued)

FOREIGN PATENT DOCUMENTS

JP 2002346023 A 12/2002
WO 2006124382 A1 11/2006
WO 2007106846 A2 9/2007

OTHER PUBLICATIONS

International Search Report and Written Opinion for PCT/IB2019/060748, mailed Feb. 24, 2020.

*Primary Examiner* — Joshua T Kennedy
(74) *Attorney, Agent, or Firm* — KDW Firm PLLC

(57) ABSTRACT

A cue includes a shaft and an end piece. The shaft has a cavity at the position of a striking end of the cue, and the cavity extends along a longitudinal axis of the cue. The end piece includes a core situated in the cavity. The end piece includes at least two ribs which extend from the core in a direction radially of the longitudinal axis. The shaft includes at least two notches at the position of the cavity, each of which includes two opposite inner walls through which the at least two ribs extend at least partially. The side walls of the at least two ribs lie against the opposite inner walls so as to connect the end piece to the shaft.

11 Claims, 3 Drawing Sheets

(56) References Cited

U.S. PATENT DOCUMENTS

| | | | | |
|---|---|---|---|---|
| 8,109,836 | B1 * | 2/2012 | Probst | A63D 15/12 473/49 |
| 2001/0051546 | A1 * | 12/2001 | Wethered | A63D 15/12 473/44 |
| 2007/0219009 | A1 * | 9/2007 | Sullivan | A63D 15/12 473/49 |
| 2017/0173446 | A1 * | 6/2017 | Costain | A63D 15/08 |
| 2019/0344155 | A1 * | 11/2019 | Kuo | A63D 15/08 |

* cited by examiner

END PIECE FOR CUE

CROSS-REFERENCE TO RELATED APPLICATION

This is a national stage application filed under 35 U.S.C. § 371 of pending international application PCT/IB2019/060748, filed Dec. 13, 2019, which claims priority to Belgian Patent Application No. BE2018/5890, filed Dec. 17, 2018, the entirety of which applications are hereby incorporated by reference herein.

FIELD OF THE INVENTION

The invention relates to a cue and a method for manufacturing a cue.

BACKGROUND OF THE INVENTION

A cue is an auxiliary means for a player in billiards and serves to direct a cue ball in the right direction with a determined speed and a desired effect. The prior art cue typically comprises a shaft and an end piece, which is connected at a striking end to the shaft. The end piece typically comprises a tip, a ferrule and optionally sound-absorbing disc. The shaft is typically hollowed out at the striking end in order to reduce the weight of the cue at the striking end. The reduced weight reduces the phenomenon of the cue ball travelling with a curve. This curving of the cue ball is also referred to as cue ball deflection.

US 2018/0085657 A1 is deemed the closest prior art and describes an end piece for a cue with a cavity at a striking end. The end piece comprises a disc configured to strike the cue against a cue ball, and a portion extending in the cavity and configured to form an attachment to an inner surface of the cavity. The portion extending in the cavity comprises one or more centering flanges and an attaching surface, wherein the centring flanges merge with the inner surface of the cavity and form a connection between the attaching surface and the inner surface of the cavity. The end piece is adhered fixedly to the inner surface of the cavity, whereby forces caused by striking the cue ball are transmitted more efficiently. An advantage of the invention described in this document is that the weight of the end piece is low and that the striking end is subject to little wear.

It is an object of the present invention to provide an alternative device and method of a cue which has a lightweight striking end and is subject to little wear.

BRIEF SUMMARY OF THE INVENTION

The invention provides for this purpose a cue comprising a shaft and an end piece, wherein the shaft has a cavity at the position of a striking end of the cue, wherein the cavity extends along a longitudinal axis of the cue, wherein the end piece comprises a core which is situated in the cavity, wherein the end piece further comprises at least two ribs which extend from the core in a direction radially of the longitudinal axis, wherein the shaft comprises at least two notches at the position of the cavity, which each comprise two opposite inner walls through which the at least two ribs extend at least partially, and wherein the side walls of the at least two ribs lie against the opposite inner walls so as to connect the end piece to the shaft.

The invention provides a shaft and an end piece. The shaft is provided with a cavity for the purpose of reducing the weight at the striking end. The shaft further has at least two notches at the striking end. These notches are configured to provide a connection to the end piece. The end piece comprises for this purpose at least two ribs. These ribs extend from a core which is situated in the cavity. The at least two ribs extend at least partially through the notches. Side walls of the ribs lie against inner walls of the notch, whereby a rotation relative to the shaft of the end piece is prevented.

For the purpose of making the notches material is removed from the shaft, whereby the weight of the shaft is lower at the striking end due to the absence of material in the notches.

Tests and simulations have shown that the impact caused by striking the cue against the cue ball is absorbed better when the end piece comprises ribs, which ribs are placed in notches of the shaft. The impact causes longitudinal and rotational forces in the end piece. Because the side walls of the ribs lie against the inner walls of the notch, rotational forces are absorbed at the position of the opposite inner walls of the notch. In other words, the forces of the impact are distributed better, whereby the cue is subject to less wear.

The invention hereby provides an alternative construction of a cue which has a lightweight striking end and which is subject to little wear.

A surprising advantage is that the ribs form a visual reference point for a player. Because the ribs extend radially through the wall of the shaft, they are visible in an outer casing of the shaft. The player can hereby use the visual reference point to better estimate a track line of the cue ball after playing. The track line is an imaginary line which tracks the cue ball after the player has struck this cue ball. Identifying and playing along the correct track line is crucial in billiards. The invention hereby further provides a cue which gives a player a visual advantage.

The at least two notches preferably extend along the longitudinal axis.

The extending of the notches along the longitudinal axis of the cue provides a relatively large contact surface between the inner walls of the notches and the side walls of the ribs. The forces of the impact are hereby better distributed. Distributing the forces of the impact makes the cue less susceptible to wear.

In addition to reducing wear, assembly of the cue is simpler since the ribs can be inserted along the longitudinal axis.

The at least two notches preferably extend from the striking end. Notching the shaft is simpler in a production process when the notches extend from the striking end. Placing of the ribs in the notches is further simpler in the production process. The cue can hereby be manufactured more cost-effectively.

The at least two notches preferably each have a depth, as measured along the longitudinal axis, and the at least two ribs preferably each have a length substantially equal to the depth, such that the at least two ribs are compatible in shape with the at least two notches. The compatibility in shape provides for a simpler mounting of the end piece on the shaft.

Distal outer surfaces of the at least two ribs preferably extend in an outer surface of the shaft, such that the distal outer surface and the outer surface of the shaft form a smooth outer casing. The ribs extending further through the notches increases a contact surface between the ribs and the shaft, more specifically at the position of the opposite inner walls. If the contact surface is greater, the forces of the impact are better distributed. This reduces the degree of wear.

The core is preferably situated at a distance from an inner surface of the shaft at the position of the cavity. The core of the end piece is hereby smaller than if it were to fill the cavity completely. This is advantageous since material is hereby saved, and the core can take a lighter form.

The end piece preferably further comprises a disc extending at least to an outer surface of the shaft in a direction radially of the longitudinal axis. Providing such a disc ensures that the forces of the impact are better distributed. More specifically, longitudinal forces, which are directed along a longitudinal axis of the cue, can be transmitted from the disc to an outer end of the shaft. This results in a further reduction in wear.

The end piece preferably comprises a tip, the end piece optionally comprises a damper. A cue is often provided with a damper for the purpose of damping sound produced during the impact. A cue is often provided with a tip for the purpose of increasing a friction between the cue and the cue ball. A player can hereby use spin more easily.

The shaft is preferably made from a composite material. Composite materials are light and at the same time strong materials, making it a frequently used material in the manufacture of cues.

The end piece is preferably chosen to have a predetermined visual contrast with the shaft. The ribs are hereby more clearly visible to the player while aiming. The ribs, which are elongate in a direction along a longitudinal axis of the cue, can hereby be used as auxiliary means, as guideline, while aiming. This is because the ribs form a line which can be followed with the eyes via the cue ball to the ball to be played to. The distance to the ball can be estimated on the basis of the length of the rib. The player can hereby aim more easily.

The end piece preferably has one or more holes for reducing a weight of the end piece. A lower weight of the end piece has the result that the weight is lower at the striking end owing to the absence of material. This lower weight has advantages, as stated above.

The invention further relates to a method for manufacturing a cue with a shaft and an end piece, wherein the end piece comprises a core and comprises at least two ribs extending from the core in a direction radially of a longitudinal axis of the core, wherein the method comprises the following steps of: providing a shaft with a cavity at the position of a striking end of the cue, wherein the cavity extends in a longitudinal direction along a longitudinal axis of the shaft; notching the shaft at least twice at the position of the striking end for the purpose of making at least two notches, which notches each comprise two opposite inner walls; placing the core in the cavity and the at least two ribs in the at least two notches, such that the ribs extend in a direction radially of the longitudinal axis of the shaft through the at least two notches, and connecting the at least two ribs to two opposite inner walls of the at least two notches.

The method provides a cue having in the shaft notches in which ribs of the end piece are situated. As elucidated at length above, a cue can hereby be provided which is lighter and less susceptible to wear.

The method preferably comprises the step of: turning the cue on a lathe, such that a distal outer surface of the ribs and an outer surface of the shaft form a smooth outer casing. During turning on a lathe components which protrude radially of the longitudinal axis are cut such that a smooth outer casing is formed. Cutting of protruding components reduces the weight of the cue further. The cue can hereby further be manufactured more cost-effectively. This is because aberrations in foregoing steps can be tolerated since turning corrects these aberrations by means of the cutting.

The connecting is preferably done by means of applying an adhesive between the at least two ribs and the two opposite inner walls of the at least two notches. An adhesive provides for a long-term and firm connection between the at least two ribs and the two opposite inner walls. The forces of the impact are hereby better distributed. As elucidated above, a cue can hereby be provided which is less susceptible to wear.

BRIEF DESCRIPTION OF THE SEVERAL VIEWS OF THE DRAWINGS

The invention will be further described with reference to an exemplary embodiment shown in the drawing.

In the drawing.

The same or similar elements are designated in the drawing with the same reference numerals.

DETAILED DESCRIPTION OF THE INVENTION

The cue according to the invention is intended for use as auxiliary means when playing billiards. Billiards is an umbrella term for different sports, such as carom billiards, bumper pool, snooker and pool. A cue is typically manufactured in different sizes and thicknesses as a result of differing requirements in the different sports. It is for example possible to distinguish between a pool cue and a snooker cue. A pool cue is typically much thicker than a snooker cue, since the cue balls are heavier in pool than in snooker. The cue serves as an extension when playing billiards. For this purpose the cue serves as an extension for striking the cue balls when playing billiards. A player hits the desired, usually white, cue ball with the cue, whereby this ball rolls over the billiards table and strikes other balls. The length and shape of the cue is adapted to the wishes of the player and the type of billiards being played.

Figure 1B:
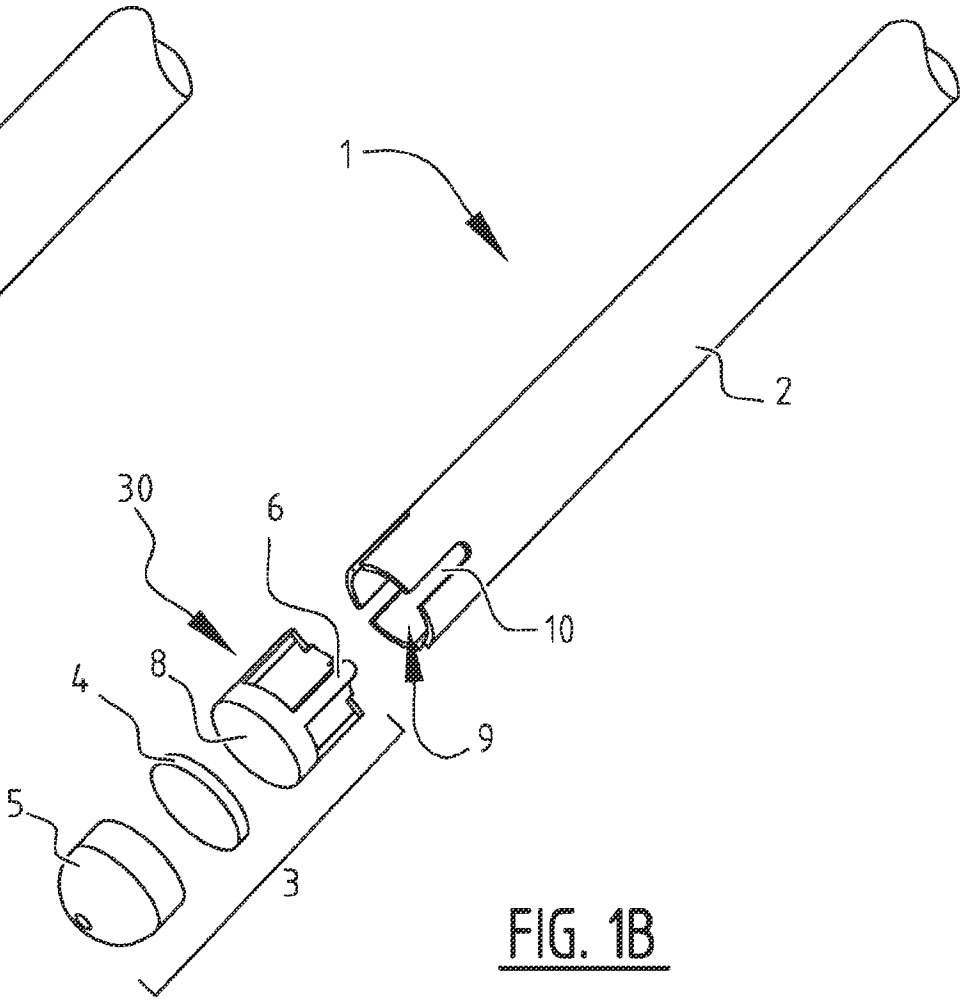
FIG. 1B shows an exploded view of a cue according to an embodiment of the invention.
Figure 1A:
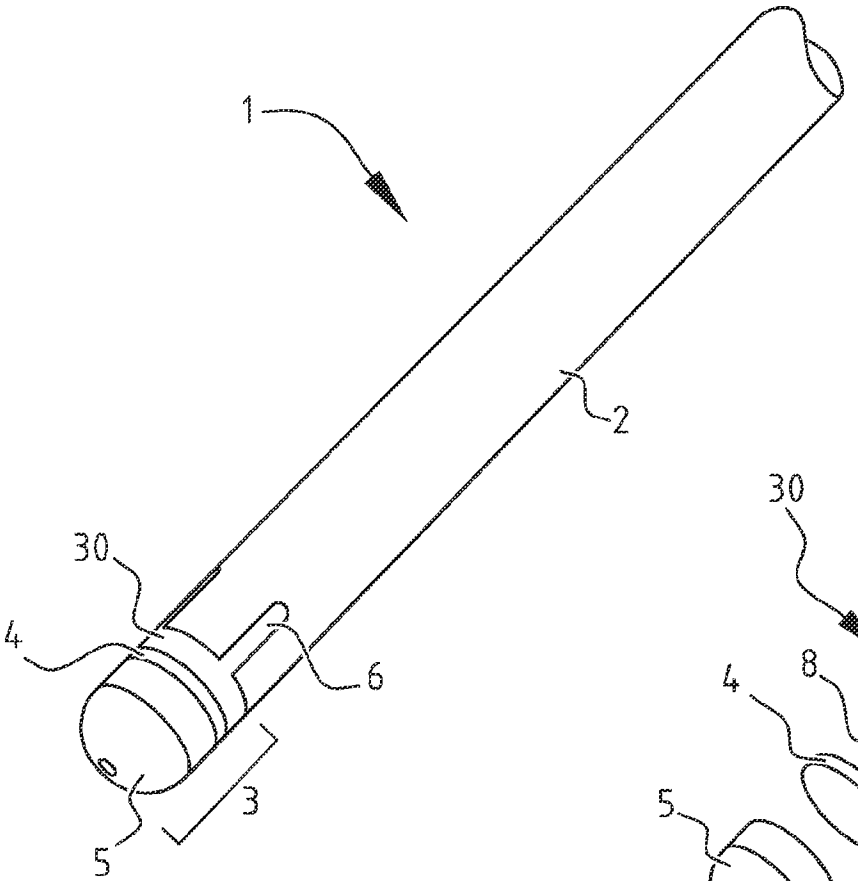
FIG. 1A shows a cue according to an embodiment of the invention.

FIG. 1 a shows a cue 1 according to an embodiment of the invention. Cue 1 comprises a shaft 2 and an end piece 3. The end piece is connected via a base body 3' to shaft 2. End piece 3 further comprises a damper 4 and tip 5. The skilled person will appreciate the base body 3', damper 4 and tip 5 can be separate components or can be manufactured integrally. Base body 3' comprises ribs 6. Shaft 2 is typically manufactured from wood or composite material. Shaft 2 is preferably manufactured from composite material.

Cue 1 is held by the player. Cue 1 further comprises a striking end which is configured to strike the cue ball. End piece 3 is for this purpose coupled to the striking end of shaft 2. End piece 3 is the component which is struck against the cue ball by the player. Since the cue ball must reach high speeds in different conditions, end piece 3 is often subject to high forces. These high forces cause wear of cue 1. More specifically, the coupling between shaft 2 and end piece 3 can break, or in extreme cases shaft 2 can break.

As a result, end piece 3 must be configured to absorb high forces.

Cue ball deflection is a known problem wherein the cue ball deflects when using side spin. The cue ball hereby deflects from the direction in which the player is aiming. Using side spin is often referred to in billiards as English. It is further known that lightening the striking end of cue 1 reduces the cue ball deflection.

The striking end of cue 1 must thus be lightweight for the purpose of reducing the cue ball deflection. End piece 3 is preferably manufactured from a composite material. End piece 3 can alternatively be manufactured from a lightweight metal such as aluminium, titanium, magnesium, beryllium or an alloy.

End piece 3 can further be provided with one or more holes. These holes reduce the weight of end piece 3, whereby the cue ball deflection is reduced further. The location and direction of the one or more holes are chosen so as to influence the cue ball deflection. In other words, the holes are provided at different locations in end piece 3 for the purpose of optimizing the cue ball deflection. Optimal cue ball deflection can differ per type of game.

Damper 4 is typically positioned between base body 3' and tip 5. The function of damper 4 is to reduce the sound which is produced during striking of the cue ball. The use of a damper 4 in cue 1 is optional. It will be apparent to the skilled person that there are embodiments of the invention which comprise no damper 4.

Tip 5 is the outermost component of cue 1. Tip 5 is hereby the element which is struck against the cue ball by the player. There are many different types of tip 5, typically distinguishable from each other by the type of material and the hardness. A soft tip 5 thus provides more grip, just as a car tyre of softer rubber, whereby more effect can be applied more easily with a cue 1 with a soft tip 5 than with a harder tip 5. A cue ball conversely has less deflection if use is made of a harder tip 5. The skilled person will appreciate that base body 3' or damper 4 can be adjusted so that the function of tip 5 can be taken on by base body 3' or damper 4. Base body 3', damper 4 and tip 5 can further form one component.

FIG. 1B shows an exploded view of a cue 1 according to an embodiment of the invention. Shaft 2 is hollowed out at the striking end. Alternatively, shaft 2 is hollow along its whole length. At least the striking end comprises a cavity 9. Cavity 9 reduces the overall weight of cue 1 at the striking end, this reducing the cue ball deflection. In this embodiment shaft 2 further comprises four notches 10 at the striking end. The four notches 10 are compatible in shape with the four ribs 6 of base body 3' of end piece 3. Base body 3' also comprises a disc 8. Disc 8 is connected via damper 4 to tip 5. End piece 3 is hereby formed.

Figure 2A:
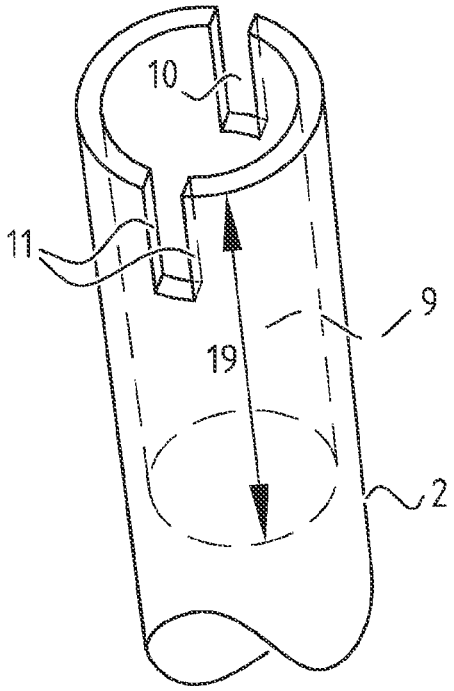
FIG. 2A shows a perspective view of a striking end according to a further embodiment of the invention.
Figure 2B:
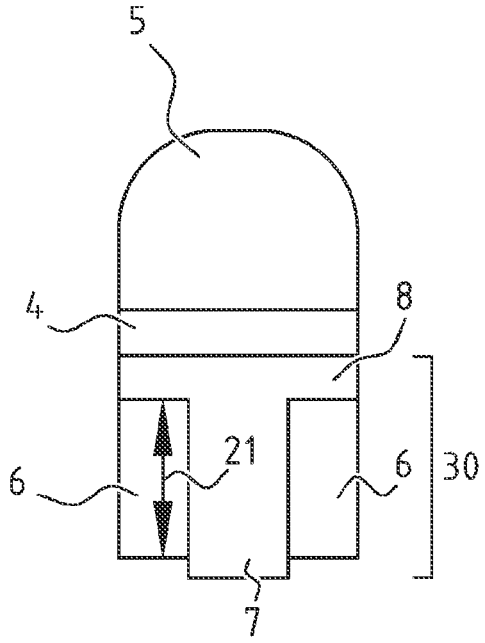
FIG. 2B shows a schematic cross-section of an end piece according to a further embodiment of the invention.

FIGS. 2A and 2B show respectively a perspective view of a striking end of shaft 2 and a side view of an end piece 3 according to a further embodiment of the invention. Cavity 9 is visibly shown in FIG. 2A. Two notches 10 are visible at the striking end of shaft 2, these notches each having two opposite inner walls 11. FIG. 2B shows the end piece 3 comprising base body 3', damper 4 and tip 5. Base body 3' further comprises two ribs 6 extending from core 7, and a disc 8. The skilled person will appreciate that the number of ribs 6 is changeable, such that the producer can choose the number of ribs 6 with the desired properties. Ribs 6 preferably have the same shape.

The ribs preferably have a rotation symmetry around the longitudinal axis. A rotation-symmetrical object has the feature that the object remains identical after a determined rotation. This object can be a two-dimensional image, whereby the rotation is a rotation around a rotation point, or a multi-dimensional object whereby the rotation is a rotation around an axis. More specifically, in rotation symmetry in the order of n, the object is the same when rotated through a minimum rotation angle of 360°/n. The ribs here preferably have a rotation symmetry around the longitudinal axis with an order of n greater than one, most preferably an order of n greater than two.

Cavity 9 serves to reduce the overall weight of cue 1. Cavity 9 has a predetermined cross-section and a predetermined depth 19. It will be apparent to the skilled person that the depth 19 of cavity 9 is adjustable, for instance in accordance with the type of billiards being played with cue 1. Cavity 9 is recessed at the striking end of shaft 2. The skilled person will appreciate that cavity 9 can alternatively extend over the whole length of cue 1. In the case that it is fully hollowed out, cue 1 is formed as a hollow tube. It will further be apparent to the skilled person that the cross-section of cavity 9 is adjustable. It is hereby possible to choose a thickness of a wall of shaft 2 located around cavity 9. Increasing the cross-section reduces the overall weight. Making the wall thinner however makes the wall less strong. Shaft 2 is able to withstand less of an impact without breaking. In other words, the optimal thickness of the wall of shaft 2 depends greatly on the type of billiards being played with cue 1.

Cavity 9 can further be filled at least partially with a filling foam. The filling foam has a sound-damping function. Hitting cue 1 against the cue ball causes vibrations in end piece 3. The damping of vibrations is desired, since vibrations cause wear. The filling foam preferably comes up against an inner surface of shaft 13. The filling foam is hereby positioned fixedly during use, whereby attaching such as adhesive are unnecessary. It will be apparent to the skilled person that the filling foam hereby has a negligible adhesive function, and primarily has a damping function.

Notches 10 extend from the striking end of shaft 2. They are configured to receive ribs 6. Notching from the striking end of shaft 2 facilitates placing of core 7 in cavity 9. During placing of core 7 ribs 6 are slid into notches 10. Side walls of ribs 6 lie against the opposite inner walls 11. Ribs 6, and as a result end piece 3, are hereby connected to shaft 2. Notches 10 are preferably cut to substantially the same depth as a length 20 of ribs 6, such that ribs 6 are compatible in shape with the notches.

The number of notches 10 and ribs 6 is equal, such that end piece 3 can be mounted on shaft 2 in simple manner. Because the ribs extend radially through the wall of the shaft, they are visible in an outer casing of the shaft. Ribs 6 preferably have a colour which contrasts a colour of shaft 2, so that ribs 2 are more clearly visible to the player. The ribs, which are elongate in a direction along a longitudinal axis of cue 1, can hereby be used as a guideline when aiming. This is because ribs 6 form a line which can be followed with the eyes. The player can hereby aim more easily.

Figure 3:
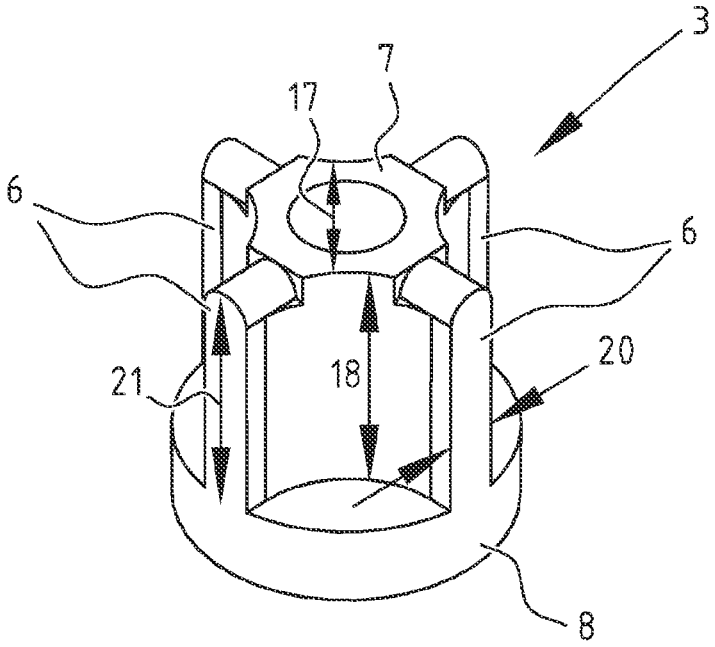
FIG. 3 shows an end piece according to a specific embodiment of the invention.

FIG. 3 shows an end piece 3 with four ribs according to a specific embodiment of the invention. End piece 3 comprises a core 7, four ribs 6 and disc 8. After mounting, core 7 is located in cavity 9. Core 7 has an elongate shape extending from disc 8 and extending in the cavity after mounting. Ribs 6 extend radially from a longitudinal axis of core 7. In mounted form the longitudinal axis of core 7 coincides substantially with the longitudinal axis of cue 1.

After mounting end piece 3 is located at the striking end of cue 1. A reduction of the weight of end piece 3 hereby reduces the cue ball deflection. End piece 3 is for this purpose preferably made of materials with a specific weight lower than 3 grams per cubic centimetre (g/cm$^3$), the specific weight is more preferably lower than 2 g/cm$^3$, more preferably lower than 1 g/cm$^3$. In addition to the type of material, the shape of end piece 3 can also be adjusted for the purpose of reducing the weight.

Core 7 is for this purpose configured to reduce the weight of end piece 3. Core 7 has a length 18 measured along the longitudinal axis of core 7, and core 7 has a cross-section 17 measured in a direction radially of the longitudinal axis. Cross-section 17 can be constant over the whole length 18. Alternatively, cross-section 17 can change. Cross-section 17 can thus change in accordance with a distance to disc 8.

During the manufacture of cue 1 ribs 6 of base body 3' are placed in notches 10. For this purpose ribs 6 extend radially from core 7, such that ribs 6 extend through notches 10. Ribs 6 preferably extend to an outer casing of shaft 2, whereby cue 1 has a smooth outer casing. A distal outer surface of ribs 6 preferably has the same curvature as the outer casing of shaft 2, whereby the difference between the outer casing of the shaft and ribs 6 cannot be felt, or hardly so. Ribs 6 have a thickness 20. In FIG. 3 each of the four ribs 6 has the same thickness 20. The skilled person will appreciate that this thickness 20 can also differ for each rib. It will further be apparent to the skilled person that the thickness 20 can be changed in accordance with the radial distance. Ribs 6, as viewed along the longitudinal axis, can thus have a trapezoidal or other similar form. A transition between ribs 6 and core 7 can be smooth or sharp. If the transition is smooth, the trapezoidal form of ribs 6 is deformed at the position of the transition. Disc 8 extends radially relative to the longitudinal axis. This results in a striking side which can be used for striking the cue ball. Alternatively, disc 8 is connected at the position of the striking side to damper 4 or tip 5. Disc 8 lies with a connecting side against shaft 2 at the position of an end surface 15. Disc 8 is preferably connected to shaft 2 at the position of end surface 15. Disc 8 preferably has for this purpose a cross-section which is substantially equal to the cross-section of shaft 2. In other words, disc 8 extends to the outer casing of shaft 2. This equal cross-section is desired since it provides a smooth transition between shaft 2 and end piece 3. The skilled person will appreciate that this is advantageous for aiming of cue 1 relative to the cue ball. Ribs 6 preferably lie against disc 8. Ribs 6 are more preferably connected to disc 8. Hereby, ribs 6 extend over a whole notch depth of notches 10 and the connection between end piece 3 and shaft 2 is more optimal.

Figure 4:
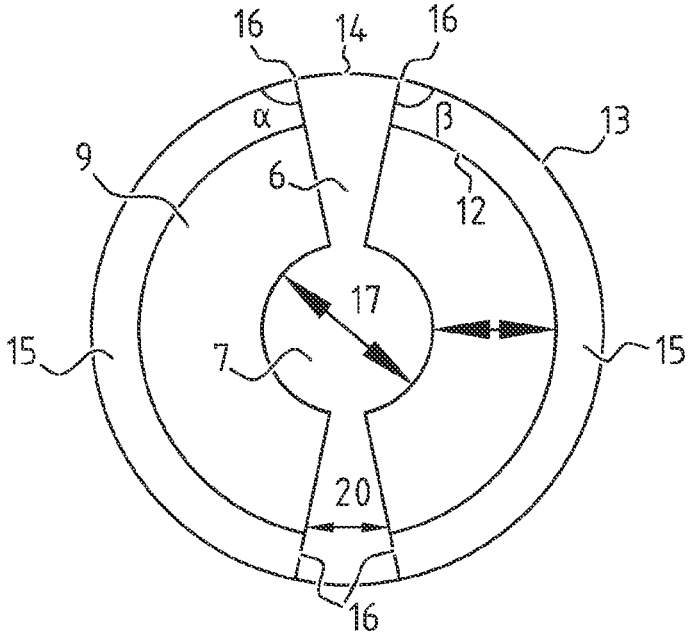
FIG. 4 shows a cross-section at a striking end of a shaft of a cue according to an embodiment of the invention.

FIG. 4 shows a cross-section at a striking end of cue 1 according to an embodiment of the invention. More specifically, FIG. 4 shows the end surface 15 of shaft 2, where core 7 of base body 3' is situated in cavity 9. Ribs 6 extend radially from the core through the notches 10. Core 7 is situated at a distance from inner surface 12 of shaft 2. Cavity 9 is hereby not wholly filled up by core 7 at the position of the cross-section, whereby weight is saved.

Ribs 6 lie against the opposite inner walls 11 of notches 10. In FIG. 4 a contact surface 16 between opposite inner walls 11 and ribs 6 is visible. Notches 10 are formed by removing a wall part of the shaft at the position of end surface 15 in a direction along the longitudinal axis. The wall part which is removed is formed by a cutting surface and the notch depth. The cutting surface is defined by an outer are on outer surface 13 and an inner are on inner surface 12. A first connection between a first outer end of the inner are and a first outer end of the outer are represents a first wall of the opposite inner walls 11, and a second connection between a second outer end of the inner are and a second outer end of the outer are represents the second wall of the opposite inner walls 11. An angle α and an angle β can for this purpose be defined between outer surface 13 and opposite inner walls 11. Angle α is preferably substantially equal to angle β. Angle α and angle β are related to the form of ribs 6. Angle α preferably has an angle size of between 60° and 120°, more preferably an angle size of between 70° and 110°, most preferably an angle size of between 80° and 100°. Angle β preferably has an angle size of between 60° and 120°, more preferably an angle size of between 70° and 110°, most preferably an angle size of between 80° and 100°. The wall part is preferably removed by cutting.

Shaft 2 and end piece 3 are connected to each other at the position of contact surface 16. Shaft 2 and end piece 3 are preferably connected by providing an adhesive layer on contact surface 16. It will be apparent to the skilled person that opposite inner walls 11 are surfaces which are created as a result of notches 10 being made, these surfaces extending between inner surface 12 and outer surface 13.

More specifically, ribs 6 extend to an outer surface of shaft 13. More specifically, distal outer surface 14 of the ribs has a smooth transition between ribs 6 and the outer surface of shaft 13. Cue 1 hereby has a smooth outer casing. The outer casing comprises the distal outer surface 14 and the outer surface of shaft 13. Distal outer surface 14 preferably has the same curvature as the outer casing of shaft 2, whereby the difference between the outer casing of the shaft and ribs 6 cannot be felt, or hardly so.

Notches 10 have a notch depth and a notch width. The depth is measured along the longitudinal axis. The notch width is defined as the distance between the opposite inner walls 11 at a determined notch depth and a determined distance radially of the longitudinal axis. The notch depth is preferably substantially the same for each notch. The notch depth is preferably greater than five millimetres, more preferably greater than one centimetre, most preferably greater than two centimetres. The notch depth is chosen irrespectively of the type of game and/or the wishes of the player. A greater notch depth increases the contact surface 16, whereby the connection between shaft 13 and ribs 6 is stronger. A smaller notch depth can be manufactured more easily, whereby the production costs can be kept low. In the distal direction the notch width is related to angle α and angle β. The maximum notch width is preferably smaller than 1 cm, more preferably smaller than 0.8 cm, most preferably smaller than 0.6 cm. The notch width is chosen irrespectively of the type of game and/or the wishes of the player.

Figure 5:
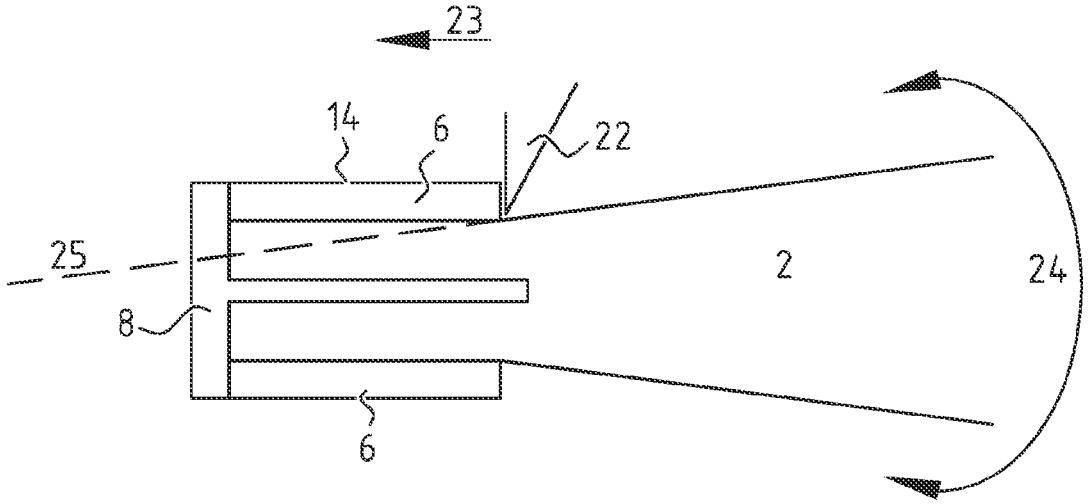
FIG. 5 shows a longitudinal section of a cue during a manufacturing step of the invention.

FIG. 5 shows a cue 1 which is being turned on a lathe. During turning cue 1 is rotated in a rotation direction 24, while a cutting tool 22 progresses in a direction of movement 23. The point of cutting tool 22 presses against cue 1 and, as a result of the rotation, cuts away a layer of material of shaft 2 and end piece 3. The point of cutting tool 22 follows a path 25, such that the striking end of cue 1 obtains the desired shape. The turning ensures that cue 1 is cut so that there is a smooth transition between distal outer surface 14 and shaft 2. Cue 1 is hereby provided with a smooth outer casing.

The skilled person will appreciate on the basis of the above description that the invention can be embodied in different ways and on the basis of different principles. The invention is not limited here to the above described embodiments. The above described embodiments and the figures are purely illustrative and serve only to increase understanding of the invention. The invention is not therefore limited to the embodiments described herein, but is defined in the claims.

The invention claimed is:

1. A cue comprising:

a shaft and an end piece, wherein the shaft has a cavity at the position of a striking end of the cue, wherein the cavity extends along a longitudinal axis of the cue, wherein the end piece comprises a core disposed in the cavity, wherein the end piece further comprises at least two ribs which extend from the core in a direction radially of the longitudinal axis, wherein the shaft comprises at least two notches at the position of the cavity, each of which comprise two opposite inner walls extending from an inner surface of the shaft to an outer surface of the shaft through which the at least two ribs extend at least partially such that they are visible at the striking end of the shaft, wherein the side walls of the at least two ribs lie against the opposite inner walls so as to connect the end piece to the shaft; and wherein the at least two notches extend from the striking end of the cue along the longitudinal axis such that the ribs can be inserted along the longitudinal axis and wherein the ribs extend radially at least partially through the wall of the shaft, wherein the at least two notches each have a depth, as measured along the longitudinal axis, and wherein the at least two ribs each have a length substantially equal to the depth, such that the at least two ribs are compatible in shape with the at least two notches.

2. The cue according to claim 1, wherein distal outer surfaces of the at least two ribs extend in relation to an outer surface of the shaft, such that the distal outer surface and the outer surface of the shaft form a smooth outer casing.

3. The cue according to claim 1, wherein the core is situated at a distance from an inner surface of the shaft at the position of the cavity.

4. The cue according to claim 1, wherein the end piece further comprises a disc extending at least to an outer surface of the shaft in a direction radially with respect to of the longitudinal axis.

5. The cue according to claim 1, wherein the end piece comprises at least one of a damper or a tip.

6. The cue according to claim 1, wherein the shaft is made from a composite material.

7. The cue according to claim 1, wherein the end piece has a predetermined visual contrast with respect to the shaft.

8. The cue according to claim 1, wherein the end piece has one or more holes for reducing a weight of the end piece.

9. A method for manufacturing a cue with a shaft and an end piece, wherein the end piece comprises a core and comprises at least two ribs extending from the core in a direction radially with respect to a longitudinal axis of the core, wherein the method comprises:

providing a shaft with a cavity at the position of a striking end of the cue, wherein the cavity extends in a longitudinal direction along a longitudinal axis of the shaft;

notching the shaft at least twice at the position of the striking end for the purpose of making at least two notches, each of which notches comprise two opposite inner walls extending from an inner surface of the shaft to an outer surface of the shaft, wherein the at least two notches extend from the striking end of the cue along the longitudinal axis such that the ribs can be inserted along the longitudinal axis and wherein the ribs extend radially at least partially through the wall of the shaft such that they are visible at the striking end of the shaft, wherein the at least two notches each have a depth, as measured along the longitudinal axis, and wherein the at least two ribs each have a length substantially equal to the depth, such that the at least two ribs are compatible in shape with the at least two notches;

placing the core in the cavity and the at least two ribs in the at least two notches, such that the ribs extend in a direction radially with respect to the longitudinal axis of the shaft at least partially through the at least two notches; and connecting the at least two ribs to two opposite inner walls of the at least two notches.

10. The method according to claim 9, comprising: turning the cue on a lathe, such that a distal outer surface of the ribs and an outer surface of the shaft form a smooth outer casing.

11. The method according to claim 9, wherein the connecting is done by means of applying an adhesive between the at least two ribs and the two opposite inner walls of the at least two notches.

* * * * *